US008025588B2

(12) United States Patent
Olson

(10) Patent No.: US 8,025,588 B2
(45) Date of Patent: Sep. 27, 2011

(54) SPORTS TRAINING DEVICE

(76) Inventor: Michael A. Olson, Bayside, WI (US)

( * ) Notice: Subject to any disclaimer, the term of this patent is extended or adjusted under 35 U.S.C. 154(b) by 0 days.

(21) Appl. No.: 12/651,516

(22) Filed: Jan. 4, 2010

(65) Prior Publication Data

US 2010/0173721 A1 Jul. 8, 2010

Related U.S. Application Data

(60) Provisional application No. 61/142,253, filed on Jan. 2, 2009.

(51) Int. Cl.
*A63B 69/36* (2006.01)

(52) U.S. Cl. ..... 473/269; 473/272

(58) Field of Classification Search ..... 473/150, 473/160, 161, 207, 217, 218, 266, 269–273, 473/278; 434/247, 252
See application file for complete search history.

(56) References Cited

U.S. PATENT DOCUMENTS 4,037,847 A 7/1977 Lorang
4,146,231 A 3/1979 Merkle et al.
4,560,165 A 12/1985 Wittemann et al.
4,577,868 A 3/1986 Kiyonaga
5,067,717 A 11/1991 Harlan et al.
5,154,427 A 10/1992 Harlan et al.
5,221,088 A 6/1993 McTeigue et al.
5,372,365 A 12/1994 McTeigue et al.
5,419,562 A 5/1995 Cromarty
5,441,265 A * 8/1995 Codlin ..... 473/160
5,564,989 A 10/1996 Larsen
5,735,751 A * 4/1998 Pacheco ..... 473/192
5,762,565 A 6/1998 Milam et al.
5,779,557 A 7/1998 Scannell et al.
5,916,036 A 6/1999 Hamilton
6,056,645 A * 5/2000 Servatius ..... 473/161
D491,246 S 6/2004 Walsh et al.
2004/0033843 A1 2/2004 Miller et al.

* cited by examiner

*Primary Examiner* — Nini Legesse
(74) *Attorney, Agent, or Firm* — Boyle Fredrickson, S.C.

(57) ABSTRACT

A sports training device is provided that conveys a perceptible cue to a user indicative of a weight transfer event for evaluating timing correctness of such weight transfer event. The device includes an enclosure having a base chamber defined therein and top wall upon which a user stands or places a foot during use. The enclosure flexes or deforms during use, while an amount of user weight supported by the enclosure changes. As the enclosure flexes or deforms, the device conveys the perceptible cue as an audible and/or visual indication of, e.g., the initiate of the weight transfer event.

15 Claims, 7 Drawing Sheets

SPORTS TRAINING DEVICE

CROSS-REFERENCE TO RELATED APPLICATIONS

This application claims the benefit of and priority to U.S. Provisional Patent Application Ser. No. 61/142,253, filed on Jan. 2, 2009, the entirety of which is expressly incorporated by reference herein.

BACKGROUND OF THE INVENTION

1. Field of the Invention

The invention relates generally to sports training devices and, more particularly, to a sports training device providing an audible indication of an individual's body weight distribution and full transfer during an athletic activity.

2. Discussion of the Related Art

A number of different sports or athletic activities require that the participant correctly shift one's weight to execute a particular stroke or swing. For example, during the golf swing, the golfer begins at an address position wherein the golfer's weight is generally centered. As the golfer begins the backswing of the golf stroke, however, the golfer's weight begins to shift from a centered position to the golfer's back foot. Once the golfer reaches the top of his or her swing, the golfer begins the downswing by transferring his or her weight to the front foot. After the weight has been shifted, the golfer pivots around the weight-bearing front leg. Finally, after striking the ball, the golfer completes his or her swing with the follow-through while maintaining the weight transfer on the front foot. Proper weight transfer is essential for consistent ball striking, and improper weight transfer is a common problem among less accomplished golfers. For example, many beginning and high handicap golfers tend to exaggerate the initial lateral movement away from the target during the backswing. They then begin the downswing with a turn of the shoulders prior to the necessary move back toward the target, thereby causing inconsistent ball striking, i.e., topping and/or hitting behind the ball. Unfortunately, most golfers do not realize that they are not adequately moving back toward the target during their downswing, and thus they continue to struggle in hitting consistent golf shots. As another example, many golfers complete their weight transfers too early, e.g., far before even completing the backswing and then fall back, again prior to impact, to their back foot.

A number of prior art devices are directed to improving a golfer's weight distribution and transfer during his or her golf swing. For example, U.S. Pat. No. 3,606,341 to Honbarger discloses a foot-holding device attached to the individual's lead foot for securing the lead foot to the ground with a heavy spike and designed to prevent lateral movement away from the target during the course of the golf swing.

U.S. Pat. No. 4,106,771 to Fern discloses a device that is clamped to the instep of an individual's shoe. The device includes a spring plate that produces an audible signal when it experiences a predetermined flexure upon a change in the angular position of the shoe. The device is configured such that the signal is produced as a proper or desired golf swing is at or near completion.

Finally, U.S. Patent Publication No. 20080015042 to Glass discloses a golf aid configured to provide audible feedback to the user as the user begins to sway away from the target during his or her backswing. The device includes a pressure sensor switch that detects an increase in vertical load at the base of the user's 5th metatarsal head. The device activates a speaker to emit an audible signal to alert the user that he or she has swayed away from the target.

These known prior art devices suffer from a number of disadvantages. For example, the device of Honbarger requires that the individual's lead foot be secured to the ground with a heavy spike. This type of device is impractical in most locations including golf courses, driving ranges, and other such practice areas. Further, the heavy spike used to secure the golfer's foot to the ground is potentially dangerous and will undoubtedly damage the ground it is inserted into. The Fern device, on the other hand, emits an audible noise that indicates a change in angle or inclination of a foot but does not emit noise in response to weight transfer. In other words, the device of Fern is configured for indicating proper follow-through rather than indicating weight transfer. Finally, the golf aid disclosed by Glass is configured to audibly indicate an initial weight application thereto, whereby it indicates a start or commencement of, but not an actual weight transfer event. Stated another way, the device of Glass can emit sounds if a majority of the golfer's weight remains on his or her back foot at ball impact, provided that the predetermined amount of weight is applied to the device, whereby it cannot be relied upon to provide an audible signal or cessation of such signal indicative of a completion of a full swing or full weight transfer event.

The need for proper and full weight transfer is not limited to golf, however. In fact, a number of other sports require similar weight transfers. For example, swinging a baseball bat, throwing a baseball or football or swinging a tennis racket requires similar such weight transfers from a participant's back foot to their front foot. As another example, when pitching a baseball, a typical movement includes a long stride toward the plate at the beginning of the swing, followed by the placement of the front foot and the throw coming from the arm of the opposite side of the front foot. Most professional pitchers do not begin moving the throwing arm toward the plate until the front foot has been placed back on the ground and the pitcher's weight has begun being transferred to the leading leg. Many people tend to start moving the throwing arm forward before the leading leg has even touched the ground, thereby bringing about a slower throw.

In light of the foregoing, a sports training device that overcomes these disadvantages and that is generally applicable to any sport activity requiring proper weight transfer is desired. Specifically, a sports training device that is relatively simple and indicates both positive and negative weight change is desired. It may further prove beneficial to provide a sports training device that emits an audible sound or visual clue only until completion of a full weight transfer event and remains silent or ceases its clue emission after the completion of the full weight transfer event and therefore after a ball striking or throwing event.

SUMMARY OF THE INVENTION

The present invention provides a sports training device that conveys a perceptible cue indicative of a weight transfer event for evaluating timing correctness of such weight transfer event. The device includes an enclosure having a base chamber defined therein and a generally planar top wall upon which a user stands during use. The enclosure flexes or deforms during use, while an amount of user weight supported by the enclosure changes. As the enclosure flexes or deforms, the device conveys the perceptible cue as an audible and/or visual indication of, e.g., the initiate of the weight transfer event. Doing so may illuminate a light or other visual display or emit a sound from the device. Doing so may also change a volume of the base chamber which forces air through a valve that is connected to the base chamber and correspondingly forces air either into or out of the base chamber, depending on whether the volume is increasing or decreasing in size. The air flowing through the valve may establish the audible cue that is indicative of the weight transfer event.

According to one aspect of the invention, a sports training device is provided that has a flexible enclosure defining a base chamber therein and having a generally planar top wall that is configured to receive a user's foot thereupon during use. The enclosure deforms in shape in response to a changing application of user weight thereto. Such shape deformations of the enclosure correspondingly change a volume of a void space of the base chamber. A valve is connected to the enclosure and is fluidly coupled to the base chamber, the valve being configured to emit an audible cue when air flows therethrough. The changing volume of the void space of the base chamber establishes an airflow through the valve so as to emit the audible cue in response to the changing application of user weight to the flexible enclosure.

In another aspect of the invention, the changing application of user weight to the flexible enclosure corresponds to a weight transfer event in which a majority of the user's weight is transferred from one of the user's feet to the other one of the user's feet.

According to another aspect of the invention, the enclosure may be collapsible under weight applied by the user thereof to expel air out of the base chamber and through the valve. The enclosure may also be expandable upon removal of the user's weight to draw air into the base chamber and through the valve. The air may flow through the valve in a first direction while expelling air out of the base chamber and the air flows through the valving in a second, opposite direction while drawing air into the base chamber.

According to yet another aspect of the invention, the enclosure includes an expanded chamber that is connected to the base chamber. The expanded chamber may have at least one of a larger height and a larger cross-sectional area, when compared to the height and cross-sectional area of the base chamber.

According to yet another aspect of the invention, the top wall may further include multiple grips that provide a friction interface between the user's foot and the top wall.

According to yet another aspect, the enclosure may have a front wall that houses the valve therein. The front wall can include an upright segment and an angled segment. The valve may be housed in, for example, the angled segment of the front wall. This allows the valve to be positioned angularly with respect to an underlying or supporting ground surface which permits use of a valve having a length that is greater than a height dimension of the enclosure at the particular location of the enclosure at which the valve is mounted or connected to the enclosure.

According to yet another aspect of the invention, the front wall defines at least part of a front side of the expanded chamber.

According to yet further aspects of the invention, the base chamber may include multiple ducts that connect to the expanded chamber. Such ducts can be defined by one or more divider walls that separate the ducts from each other in the base chamber. The divider walls may extend generally orthogonally from the top wall and into the base chamber, and/or may connect the top wall to a bottom wall of the enclosure. The bottom wall may have a lower surface that undulates along at least one of a width and length dimension and sits upon a supporting ground surface. The bottom wall may include multiple grooves that are defined between respective multiple lands which contact a supporting ground surface. One or more of the multiple lands of the bottom wall may have a convex bottom surface.

Accordingly to another aspect of the invention, the enclosure may include upper and lower shells that are connected to each other through a joint. The joint may extend about a major portion of the entire perimeter(s) of the upper and lower shells. The joint can at least partially define a lap-type interface, for example, in which a portion of a sidewall of one of the upper and lower shells overlaps or abuts and is outside of a portion of a sidewall of the other one of the upper and lower shells. The joint may further include various projections, such as inwardly extending lips that provide shoulder surfaces for cooperating edges of the shells to sit against.

According to another aspect of the invention, the top wall may include a ramped portion against which a side of the user's foot abuts during use.

According to another embodiment of the invention, a method of teaching proper weight transfer in a sporting activity is provided, by utilizing a relatively pliant and flat enclosure having a valve mounted therein, the valve being configured to emit an audible cue when air flows therethrough in response to a weight transferring event by a user. The enclosure is secured between a foot of the user foot and an underlying ground surface, such that the user's foot is positioned upon the enclosure. The user performs an athletic maneuver that requires a weight transferring event and an audible cue is emitting from the valve during such weight transferring event. A timing of the emission of the audible cue versus a desired timing of the weight transferring event is evaluated.

BRIEF DESCRIPTION OF THE DRAWINGS

A preferred exemplary embodiment of the invention is illustrated in the accompanying drawings in which like reference characters represent like parts throughout.

DETAILED DESCRIPTION OF THE PREFERRED EMBODIMENTS

Figure 1:
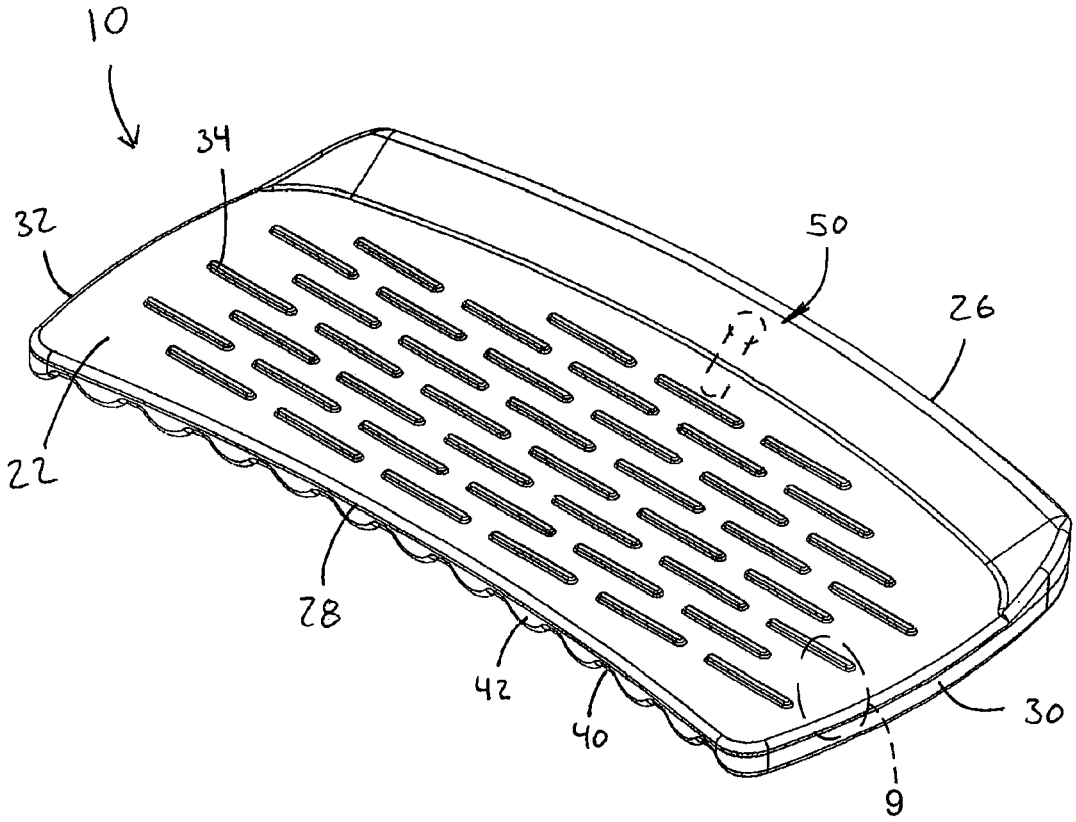
FIG. 1 is an isometric view of a first embodiment of a sports training device in accordance with the present invention.

Preferred exemplary embodiments of the sports training device of the present invention are illustrated in the accompanying drawings in which like reference numerals represent like parts throughout.

Referring now to the drawings, and initially to FIG. 1, a sports training device 10 is illustrated which is configured to emit an audible indication of an occurrence of a foot-to-foot weight transfer event by a user. The sports training device 10 includes an enclosure 12 and a weight transfer indicator, such as indicator assembly 50 that cooperates with the enclosure 12 to emit a cue such as a sound or visual indicator during, and/or otherwise indicate, such a weight transfer event, explained in greater detail elsewhere herein.

Referring now to FIGS. 1-6, the enclosure 12 includes an upper shell 14 and a lower shell 16, surrounding an interior void space. The interior void space includes a base chamber 18 and an expanded chamber 20 that collectively occupy the volume defined within the inwardly facing surfaces of the upper and lower shells 14, 16. Although the enclosure 12 is described in terms of an upper shell 14 and a lower shell 16 as being discrete components that are joined to form the enclosure 12 that surrounds the void interior of the base and expanded chambers 20, this is done as a matter of convenience of description noting that the upper and lower shells 14, 16 can, of course, be portions of a single unitary or continuous structure. Accordingly, whether incorporated into a single or multiple component enclosure 12, the upper and lower shells 14, 16 are defined by respective ones (or portions) of a top wall 22, bottom wall 24, front wall 26, back wall 28, and sidewalls 30, 32 that are connected to each other in the complete assemblage of the enclosure 12.

Figure 2:
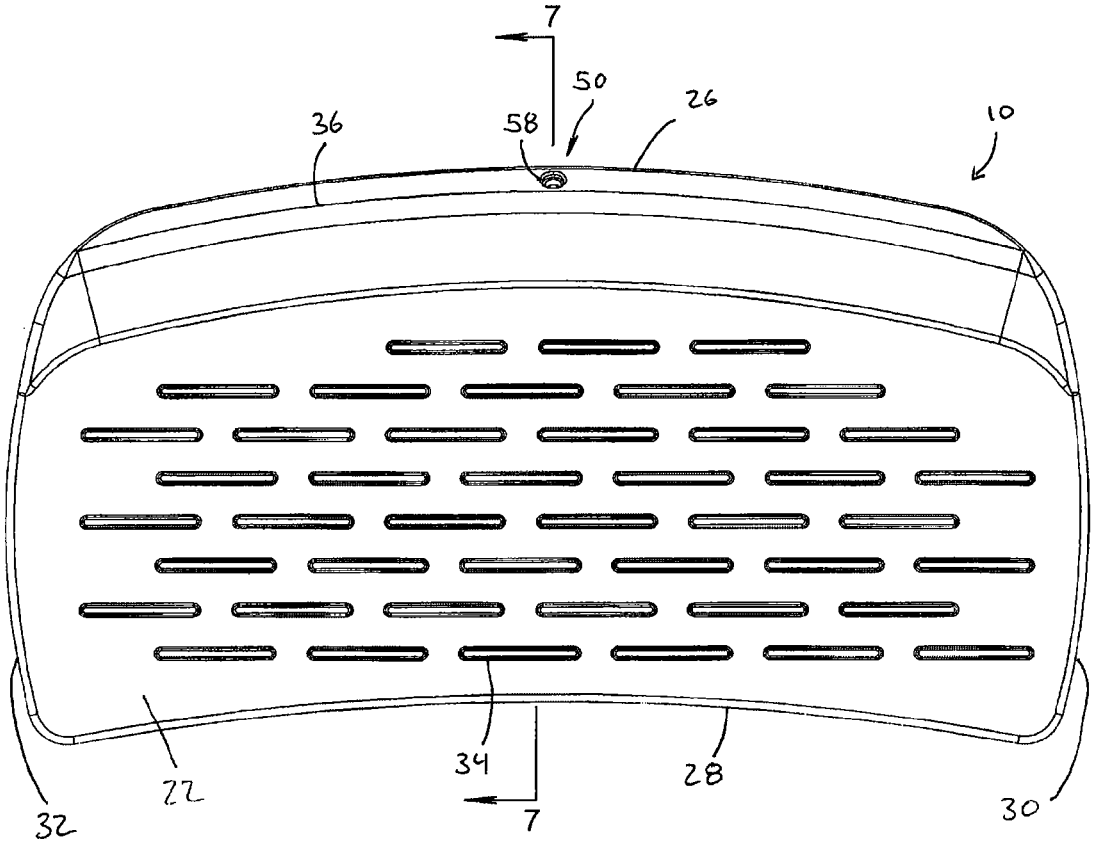
FIG. 2 is a top plan view of the sports training device FIG. 1.
Figure 6:
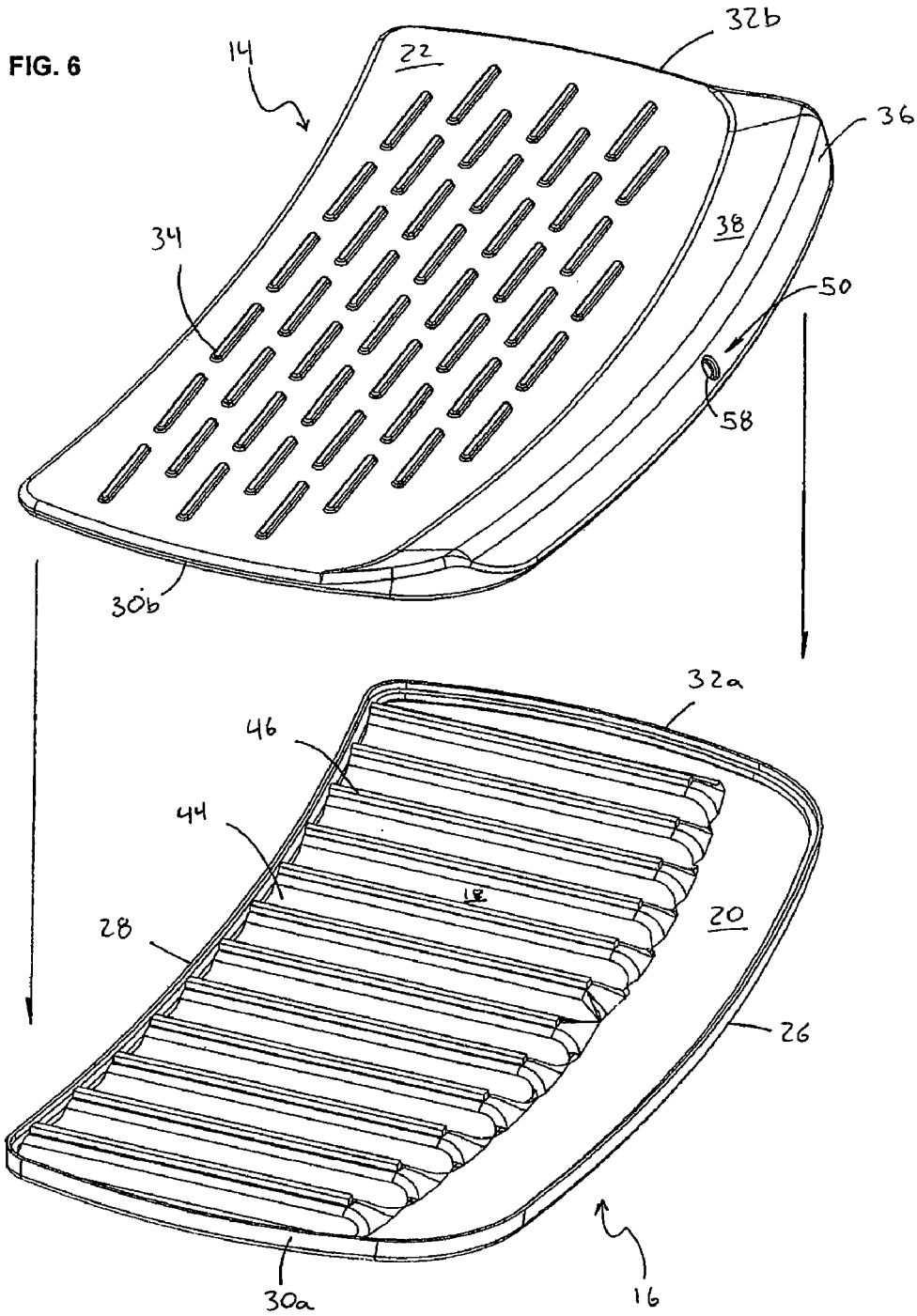
FIG. 6 is an exploded isometric view of the sports training device of FIG. 1
Figure 7:
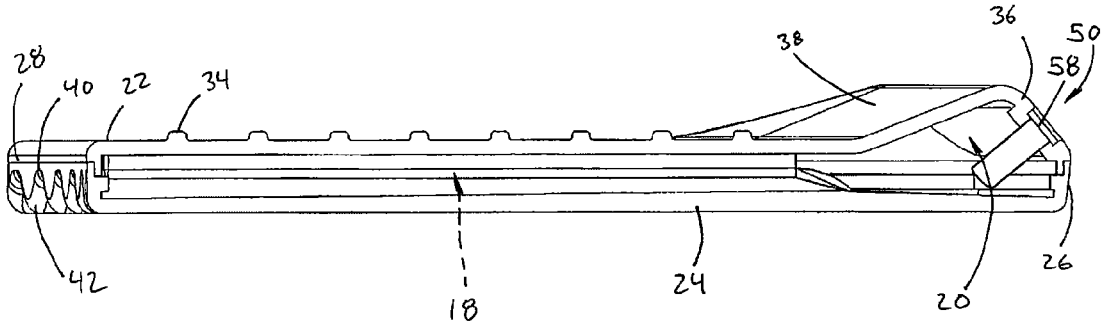
FIG. 7 is side cross-sectional view of the sports training device of FIG. 1, taken at line 7-7 of FIG. 2.

Referring now to FIGS. 1, 2, and 6, top wall 22 is contoured to receive a user's shoe-clad foot across the length thereof Multiple grips 34 are located on an upper surface of the top wall 22. The grips 34 are configured to provide the user's foot with increased frictional engagement when the sports training device 10 is in use. As illustrated in FIG. 1, the grips 34 may be integral with the top surface 22, and may be comprised of raised rubber. However, any material or orientation capable of increasing the frictional engagement of the user's foot and the top surface 22 may be incorporated.

Figure 5:
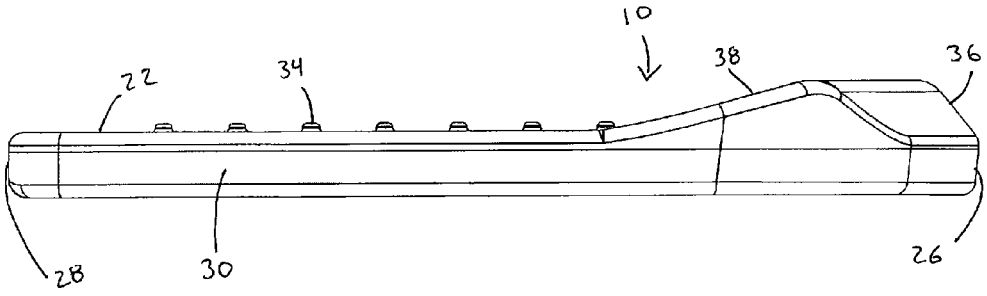
FIG. 5 is a side elevation view of the sports training device of FIG. 1.

Referring now to FIGS. 1 and 5, located at the ends of the top wall 22, and extending downwardly therefrom, are the sidewalls 30, 32 of the enclosure 12. In this configuration, the sidewalls 30, 32 define a length dimension of the device 10 therebetween and are located adjacent to the user's heel and toes, respectively, during use. The sidewalls 30 and 32 are substantially mirror images of each other, whereby only description of sidewall 30 is made here, noting that it is applicable to sidewall 32 by analogy. Seen best in FIG. 5, when viewed from the side, sidewall 30 defines a rectangular back segment and a ramped or angled front segment. A height dimension of the sidewall's 30 back segment corresponds closely to a height dimension of the base chamber 18, noting that an inwardly facing surface of sidewall 30 defines an outer boundary of the chamber 18.

Referring still to FIGS. 1 and 5, the height of the sidewall 30 is substantially less than the overall width and/or length(s) of the device 10, giving the chamber 18 and device 10 a generally thin and flat configuration. For example, the height of the sidewall's 30 back segment can be about 1/10 of the width of the device 10 (or less than 1/10) and 1/20 of the length of the device 10 (or less than 1/20). A height dimension of the sidewall's 30 angled front segment corresponds closely to a height dimension of the expanded chamber 20 which abuts the inwardly facing surface of the angled front segment. The embodiment of FIG. 5 has an angled front segment of sidewall 30 that is somewhat triangular, with converging angled segments that join at a greatest height portion. At its greatest height portion, the angled front segment of sidewall 30 is nearly twice as tall as the height of the back portion, for example, being at least about 1.5 times the height thereof. Accordingly, the expanded chamber 20 may be a portion of the device's 10 interior void space that increases in height with respect to the base chamber 18, but need not indicate or require that the volume of the expanded chamber 20 is larger than the volume of the base chamber 18, which it may or may not be, depending on the overall desired configuration of the device.

Figure 4:
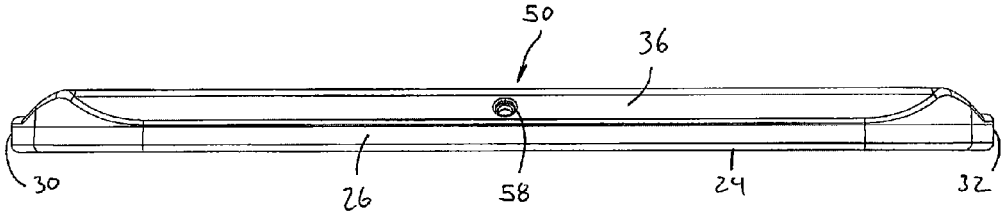
FIG. 4 is a front elevation view of the sports training device of FIG. 1.

Referring now to FIGS. 1, 4, and 6, regardless of the particular configurations of sidewalls 30 and 32, they span across the width of the enclosure 12, at its ends, connecting the front and back walls 26, 28 to each other. In the illustrated embodiments, the device 10 is unidirectional, such that the front wall 26 is configured for placement adjacent an outside (or leading side) of a user's (leading or other) foot. However, since the device 10 is symmetrical about a line extending transversely across its width and midway along its length, the device 10 can be placed under and used with either the right foot or the left foot of the user.

The front wall 26 extends in a slight arcuate path between the sidewalls 30 and 32, defining a convex surface at the front of the enclosure 12. Front wall 26 includes an upright or generally vertical lower segment and an angled upper segment 36 that extends toward a remainder of the device 10. A top edge of the upper segment 36 is connected to the ramped segment 38 of the top wall 22 which extends away from such point of connection and has an opposing angle of inclination, when compared to that of upper segment 36 of the front wall 26. In other words, the ramped and angled segments 38 and 36 of the top and front walls 22 and 26, respectively, angle toward and connect to each other to define surfaces that correspond to the triangular-like ramped or angled front segments of the sidewalls 30, 32. In this regard, the angled segment 38 of the top wall 22 provides an abutment surface against which the user places an outside of his or her foot during use. Furthermore, the ramped and angled segments 38 and 36 of the top and front walls 22 and 26 overlie and define an uppermost perimeter of the expanded chamber 20. Accordingly, since the ramped and angled segments 38 and 36 of the top and front walls 22 and 26 rise upwardly from the remainder of top wall 22, intuitively, the expanded chamber 20 defines an area of at least one of an increased internal void height, cross-sectional area, and/or volume, relative to the base chamber 18.

Referring again to FIG. 1, back wall 28 extends downwardly from a back edge of the top wall 22 and in a slight arcuate path between the other ends of sidewalls 30 and 32. The back wall 28 is substantially parallel to the front wall 26, such that the back wall 28 defines a concave back surface of the enclosure 12. The bottom edge of back wall 28 is wavy or undulating in a manner that corresponds to the surface configurations of bottom wall 24, explained in greater detail elsewhere herein.

Figure 3:
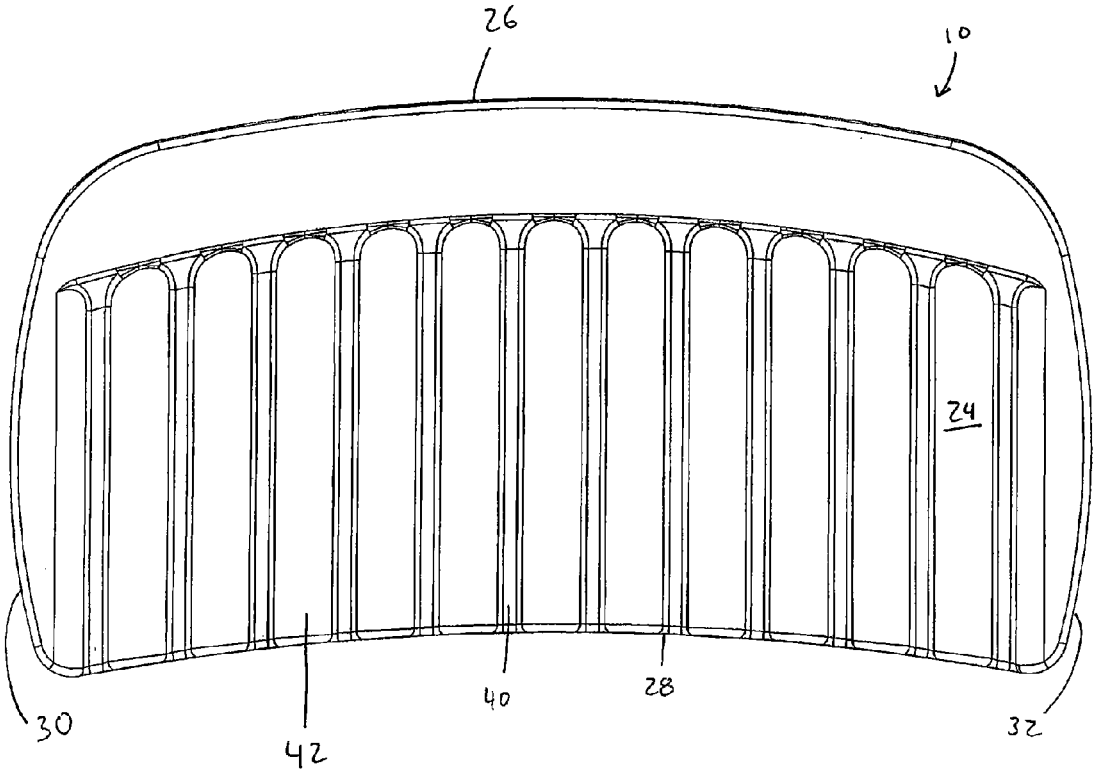
FIG. 3 is a bottom plan view of the sports training device of FIG. 1.
Figure 8:
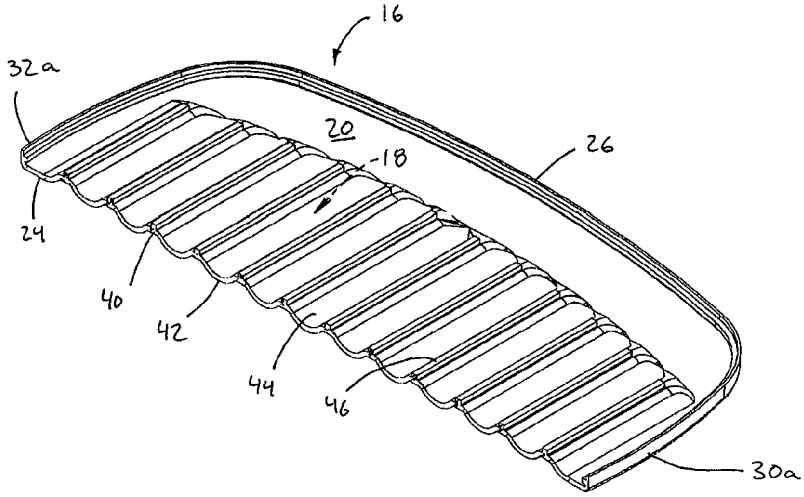
FIG. 8 is an isometric view of a lower shell of the sports training device of FIG. 1.
Figure 9:
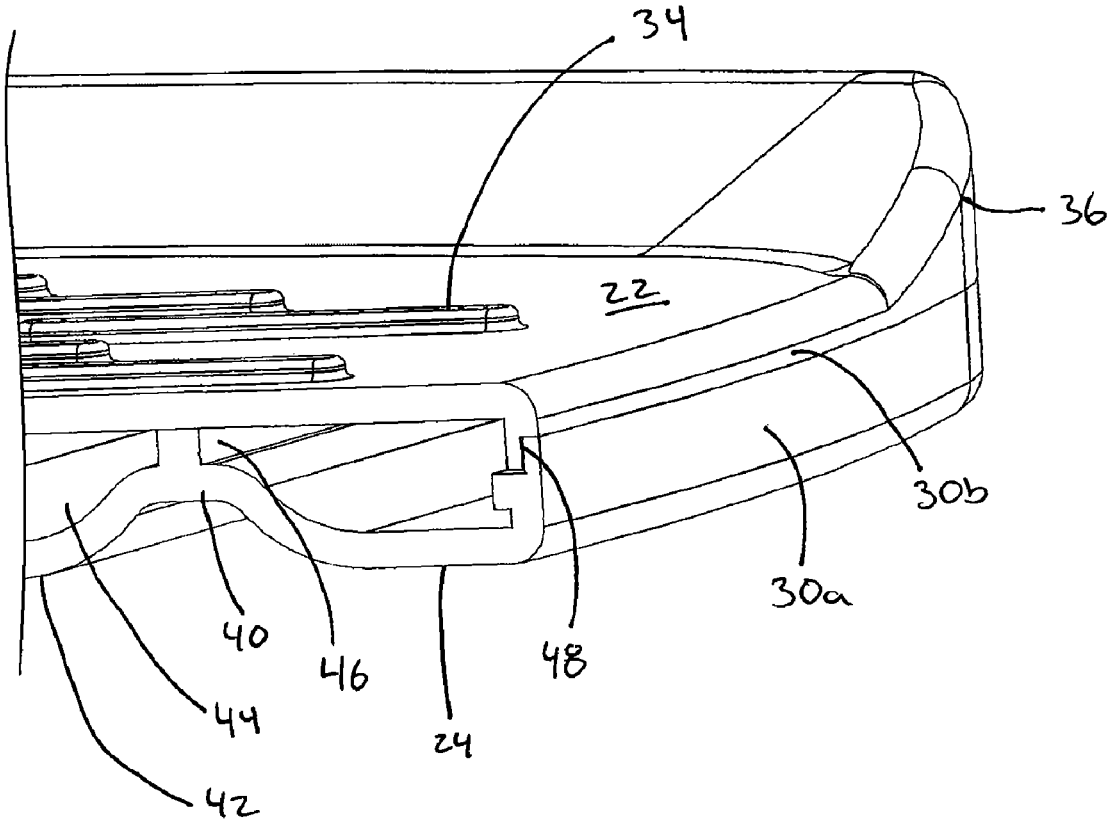
FIG. 9 is an isometric and enlarged cross-sectional view of a portion of the sports training device of the present invention, taken at the dashed circle 9 of FIG. 1.

Referring now to FIGS. 1 and 6-9, the front and back walls 26, 28 and the sidewalls 30, 32 can each be a single unitary structure or can be an assemblage of multiple segments that are connected to each other, such as in the embodiments of enclosure 12 that include upper and lower shells 12, 14 that are joined together. Stated another way, the joint between the upper and lower shells 12 and 14 can be provided along the outer perimeter of the enclosure 12, extending through the front and back walls 26, 28 and the sidewalls 30, 32, in series. FIG. 9 shows a close-up view of a preferred configuration of an exemplary joint and will explained with respect to sidewall 30, while noting that such discussion is equally applicable to sidewall 32 and also the front and back walls 26, 28 which can have the same joint configuration and/or profile. Joint 48 connects the upper and lower shells 14, 16 to each other, partway up the height of the sidewall 30, by connecting upper segments 30*a*, 32*a* of sidewalls 30, 32 to lower segments 30*b*, 32*b* of sidewalls 30, 32 (FIG. 8). The joint 48 has a step-like configuration and preferably defines a lapping interface between the upper and lower shells 14, 16. Seen best in FIG. 9, the joint 48 includes part of the lower segment 30*a* that is outside of, overlapping an abutting, part of the upper segment 30*b*. Lower segment 30*a* further includes a lip that projects into the interior space of the enclosure 12, defining an upwardly facing shoulder that supports a downwardly facing surface of the upper segments 30*b*. Joint 48 may include various other projections and/or interlocking structures, depending on the particular desired end configuration of the enclosure 12, that allow the joint 48 to suitably connect the respective upper and lower segments 30*a*, 32*a*, and 30*b*, 32*b* in a manner that allows the front and back walls 26, 28, and the sidewalls 30, 32 to connect the upper wall 22 to the bottom wall 24 at their respective perimeter edges. As illustrated in FIG. 3 from below the bottom wall 24, a downwardly facing surface of the bottom wall 24 includes a plurality of grooves 40 extending across at least a portion of its width and a plurality of elevated lands 40 separating each of the grooves 40. The lands 42 are configured to provide increased frictional engagement between the sports training device 10 and the ground during use, and are positioned perpendicular to a longitudinal axis of the user's foot. The grooves 40 and lands 42 may extend across the entire width of the bottom wall 24, or alternatively, the grooves 40 and the lands 42 may extend across the width of the bottom wall 24 from the rear wall 28 to the expanded chamber 20.

Turning now to FIGS. 6-9, an upper surface of the bottom wall 24 defines a lower perimeter of the base chamber 18 and the base chamber 18, itself, can include multiple concave ducts 44 that are separated from each other by divider walls 46, which guide or direct airflows through the ducts 44, toward the expanded chamber 20 and thus also toward valve 58. The divider walls 46 are formed of vertical extensions originating from the grooves 40 of the bottom wall 24 and engaging the interior surface of the upper shell 16, whereby the divider walls 46 connect the top and bottom walls 22, 24 to each other.

In this configuration, each of the ducts 44 is separated transversely from the adjacent ducts 44 by the divider walls 46 and is sealed at a back end by the back wall 28. At the other or front end of each of the ducts 44, the duct 44 opens into the expanded chamber 20. Accordingly, the divider walls 46 and ducts 44 therebetween ensure that air flowing through the base chamber 18 is restricted to flow directions that correspond to the width of the enclosure 12, whereby air will not spill or otherwise flow between adjacent ducts 44 in a lengthwise direct of the enclosure 12. Since the ducts 44 and divider walls 46 end at the expanded chamber 20, the base chamber 18 is in fluid communication with the indicator assembly 50 by way of the intervening expanded chamber 20.

As illustrated in FIGS. 1, 2, 4, and 7, the indicator assembly 50 is provided in the front wall 26 of these embodiments, noting that indicator assembly 50 can be provided elsewhere within the device 10, as long as the enclosure 12 and indicator assembly 50 can suitably cooperate to emit an audible sound or other perceptible indicator or cue in response to changing weight application to the enclosure 12. For example, in some embodiments, the indicator assembly 50 is provided in one or both of the ramped and angled segments 39 and 36, and/or elsewhere within the enclosure 12.

The location of the indicator assembly 50 is influenced by the particular configuration of the indicator assembly 50 and the intended functionality, for example, when or in response to what stimulus the indicator assembly 50 will emit an audible signal. In some embodiments, indicator assembly 50 is configured to emit an audible sound in response to any changing weight application to the enclosure 12, such that with a user standing on the device 10, an audible cue is produced anytime that the user shifts more or less of his or her weight onto or from the foot in contact with the sports training device 10. In some embodiments, after a user is standing on the device 10, the indicator assembly 50 only emits sound when the device 10 experiences an increase in pressure or user weight applied thereto. In yet other embodiments, the indicator assembly 50 is configured to only emit sound when the device 10 experiences a decrease in pressure or use weight applied thereto.

In some embodiments, the indicator assembly 50 is an electronic system that includes, e.g., one or more pressure sensors or mechanical switches that mounted proximate the top or front walls 22, 26 or elsewhere, so long as they are positioned and configured to sense or be actuated by the predetermined stimulus, such as (i) any changes in pressure or weight application to the enclosure 12, (ii) increases in pressure or weight application to the enclosure 12, and/or (iii) decreases in pressure or weight application to the enclosure 12. Such sensors or switches send a corresponding signal, indicative of such a weight transfer event, to a speaker, buzzer, or other suitable sound device for emitting a corresponding audible sound indication of such event, optionally to an optical device, such as a bulb or other illuminating device, for visually indicating the same, if so desired. Such electronic system further includes cooperating components that are known to those skilled in the art, such as, e.g., batteries or other power supplies, electrical conductors that connect the various components, and other requisite circuit components that may be integrally incorporated into one or more integrated circuits. The electronic system can also be microprocessor based, whereby it includes various suitable computing resource(s) such as, for example, inputs and outputs that are operably connected to a memory device and a microprocessor with an operating system that is configured to perform the desired audible or visually conspicuous emissions that indicate weight transfer events of the user.

Still referring to FIGS. 1, 2, 4, and 7, the indicator assembly 50 is preferably configured to emit an audibly perceptible cue. In these embodiments, the indicator assembly 50 is configured as a pneumatic sound generating device and includes a bidirectional (or other) air valve 58 that is mounted at a central location upon the front wall 26 and in fluid communication with the base chamber 18 by way of the expanded chamber 20. Valve 58 may be a pneumatic valve which is at least somewhat similar to the kind generally known in the art, being also configured to emit an audibly conspicuous sound when air flows therethrough. The emission of this sound corresponds to the transfer of air through valve 58, and is accordingly triggered by the user changing the amount of weight or force applied to the sports training device 10 by the overlying foot. In this configuration, the sound emission of the sports training device 10 provides an audible cue to the user thereof. The audible cue allows the user or the user's instructor to evaluate the user's weight transfer timing, especially with respect to the dynamic golf swing components.

Referring yet further to FIGS. 1, 2, 4, and 7, valve 58 can be configured such that it emits an audible cue when either a positive or negative weight change is applied to the sports training device 10, optionally, during only one airflow direction. In other words, the valve 58 could be configured such that with a user standing on the device 10, no audible cue is produced unless the user shifts more or less of his or her weight onto the foot in contact with the sports training device 10. In other embodiments, after a user is standing on the device 10, the valve 58 only emits sound when the device 10 experiences an increase in pressure applied thereto. In yet other embodiments, the valve 58 is configured to only emit sound when the device 10 experiences a decrease in pressure applied thereto.

With respect to a golf swing, a preferred configuration of valve 58 may be the one in which an audible cue is emitted when either a positive or negative weight change is applied to the sports training device 10. Accordingly, this valve 58 configuration would be used when the goal is to achieve a swing wherein the user receives an audible cue only during the downswing, prior to striking the ball. Specifically, when the user shifts his or her weight to his or her back foot during the takeaway and backswing, the user's front foot should be relatively stable on the sports training device 10 thereby resulting in the absence of any audible cue until just prior to the finish of the backswing. Once the user's weight begins to shift from his or her back foot and the downswing starts, there should be an immediate audible cue. Prior to impact, all audible cue should end and have no further cues through to completion of the swing. At this point, the user's weight has been transferred to the front foot; the player would pivot around the forward weight bearing leg and impact the ball. The weight should then remain bearing on the forward foot during the follow-through and into the completion of the swing, without adding additional weight to the foot contacting the sports training device 10.

The sports training device 10 of the present invention may be utilized in a variety of different sports including, but not limited to, golf, baseball, football, and tennis. The device 10 of the present invention may be utilized as a training device in any sport that requires a user-initiated weight transfer similar to the aforementioned sports.

Many changes and modifications may be made to the present invention without departing from the spirit thereof. For example, in some implementations, the device 10 can be configured to selectively or removably fix, attach, or anchor to the ground. Such removably anchoring functionality can be accomplished in any of a variety of suitable ways, including but not limited to, (i) molding or otherwise providing a throughbore vertically through the device 10 that can accept a spike and/or other anchoring device therethrough, (ii) molding or otherwise providing a tab that extends from the outer perimeter of the device 10 and lies upon the ground, the tab having a throughbore or other suitable spike and/or anchoring device accepting structure(s), and/or (iii) molding or otherwise providing an integral spike and/or anchoring device that always remains attached to the device 10, for example, as a downwardly directed claw-type structure that can penetrate the ground. The scope of some of these changes is discussed above. The scope of others will become apparent from the appended claims.

What is claimed is:

1. A sports training device comprising:

a flexible enclosure defining a base chamber therein and having a generally planar top wall that is configured to receive a user's foot thereupon during use, the enclosure deforming in shape in response to a changing application of user weight thereto, such that the shape deformations of the enclosure correspondingly change a volume of a void space of the base chamber; and indicator assembly connected to the enclosure and being configured to convey a perceptible cue to a user in response to a changing application of user weight to the flexible enclosure, the indicator assembly further comprising a valve that is fluidly coupled to the base chamber, the valve being configured to emit an audible cue when air flows therethrough, and wherein the changing volume of the void space of the base chamber establishes an airflow through the valve so as to emit the audible cue.

2. The sports training device of claim 1, wherein the enclosure is collapsible under weight applied by the user thereof to expel air out of the base chamber and through the valve and wherein the enclosure is expandable upon removal of the user's weight to draw air into the base chamber and through the valve.

3. The sports training device of claim 2, wherein the air flows through the valve in a first direction while expelling air out of the base chamber and the air flows through the valving in a second, opposite direction while drawing air into the base chamber.

4. The sports training device of claim 1, the enclosure further comprising an expanded chamber connected to the base chamber, the expanded chamber having at least one of a larger height and a larger cross-sectional area with respect to the base chamber.

5. The sports training device of claim 4, the top wall further comprising multiple grips providing a friction interface between the user's foot and the top wall.

6. The sports training device of claim 4, the enclosure further comprising a front wall housing the valve therein.

7. The sports training device of claim 6, the front wall further comprising an upright segment and an angled segment, and wherein the valve is housed in the angled segment of the front wall.

8. The sports training device of claim 6, the front wall defining a front side of the expanded chamber.

9. The sports training device of claim 4, the base chamber further comprising multiple ducts that connect to the expanded chamber.

10. The sports training device of claim 9, the enclosure further comprising multiple divider walls that separate the ducts from each other in the base chamber.

11. The sports training device of claim 9, wherein the divider walls extend generally orthogonally from the top wall and into the base chamber.

12. The sports training device of claim 11, wherein the divider walls connect a bottom wall of the enclosure to the top wall of the enclosure.

13. The sports training device of claim 2, the enclosure further comprising a bottom wall having a lower surface that undulates along at least one of a width and length dimension and sits upon a supporting ground surface.

14. A sports training device comprising:

a flexible enclosure defining a base chamber therein and having a generally planar top wall that is configured to receive a user's foot thereupon during use, the enclosure deforming in shape in response to a changing application of user weight thereto, such that the shape deformations of the enclosure correspondingly change a volume of a void space of the base chamber; and indicator assembly connected to the enclosure and being configured to convey a perceptible cue to a user in response to a changing application of user weight to the flexible enclosure, the enclosure further comprising a bottom wall having a lower surface that undulates along at least one of a width and length dimension and sits upon a supporting ground surface, and the bottom wall having multiple grooves defined between corresponding multiple lands which contact a supporting ground surface.

15. The sports training device of claim 14, each of the multiple lands further comprising a convex bottom surface.

* * * * *